US011592245B2

(12) United States Patent
Noël-Baron

(10) Patent No.: US 11,592,245 B2
(45) Date of Patent: Feb. 28, 2023

(54) BAFFLE

(71) Applicants: ALFA LAVAL CORPORATE AB, Lund (SE); ALFA LAVAL VICARB SAS, Fontanil-Cornillon (FR)

(72) Inventor: Olivier Noël-Baron, Echirolles (FR)

(73) Assignees: ALFA LAVAL CORPORATE AB, Lund (SE); ALFA LAVAL VICARB SAS, Fontanil-Cornillon (FR)

( * ) Notice: Subject to any disclaimer, the term of this patent is extended or adjusted under 35 U.S.C. 154(b) by 79 days.

(21) Appl. No.: 16/646,383

(22) PCT Filed: Sep. 4, 2018

(86) PCT No.: PCT/EP2018/073731
§ 371 (c)(1),
(2) Date: Mar. 11, 2020

(87) PCT Pub. No.: WO2019/052854
PCT Pub. Date: Mar. 21, 2019

(65) Prior Publication Data

US 2020/0271401 A1 Aug. 27, 2020

(30) Foreign Application Priority Data

Sep. 15, 2017 (EP) ..... 17191228

(51) Int. Cl.
*F28F 13/06* (2006.01)
*F28D 9/00* (2006.01)
*F28F 3/08* (2006.01)

(52) U.S. Cl.
CPC ..... *F28F 13/06* (2013.01); *F28D 9/0093* (2013.01); *F28F 3/08* (2013.01)

(58) Field of Classification Search
CPC ..... F28D 9/0093; F28D 9/02; F28D 9/0068; F28D 9/0018; F28F 13/06; F28F 2225/06;
(Continued)

(56) References Cited

U.S. PATENT DOCUMENTS 2,601,974 A * 7/1952 Hytte ..... F28F 3/083 403/319
4,215,745 A * 8/1980 Tuckmantel ..... F28F 9/005 165/DIG. 411

(Continued)

FOREIGN PATENT DOCUMENTS

CN 13535807 A 6/2002
CN 103459966 A 12/2013

(Continued)

OTHER PUBLICATIONS

Office Action (Notice of Preliminary Rejection) dated May 28, 2021, by the Korean Intellectual Property Office in corresponding Korean Patent Application No. 10-2020-7010670 and an English Translation of the Office Action. (7 pages).

(Continued)

*Primary Examiner* — Jianying C Atkisson
*Assistant Examiner* — Christopher C Pillow
(74) *Attorney, Agent, or Firm* — Buchanan Ingersoll & Rooney PC

(57) ABSTRACT

A baffle for a block-type heat exchanger comprising a baffle plate. The baffle plate comprises a first surface and a second surface being parallel to a baffle plane located between the first surface and the second surface. The baffle plate comprises a first longitudinal edge, a second longitudinal edge, a first transverse edge and a second transverse edge. The baffle comprises a resilient member at the second longitudinal edge. The baffle comprises a reinforcement extending away from the baffle plane.

22 Claims, 7 Drawing Sheets

(58) Field of Classification Search
CPC .. F28F 3/08; F28F 3/083; F28F 9/0075; F28F 2009/222; F28F 2009/226; F28F 2225/00; F28F 2230/00; F28F 2250/102; F28F 9/22
See application file for complete search history.

(56) References Cited

U.S. PATENT DOCUMENTS

| | | | | |
|---|---|---|---|---|
| 4,848,451 | A * | 7/1989 | Jonsson | F28F 3/083 165/DIG. 356 |
| 5,339,891 | A | 8/1994 | Kidaloski et al. | |
| 6,102,111 | A * | 8/2000 | Kamio | F28D 9/0018 165/DIG. 399 |
| 6,341,649 | B1 * | 1/2002 | Joshi | F28D 1/0333 165/167 |
| 2012/0205086 | A1 * | 8/2012 | Nakamura | F28F 3/08 165/181 |
| 2013/0299146 | A1 * | 11/2013 | Blomgren | F28F 3/08 165/166 |
| 2015/0021904 | A1 * | 1/2015 | Perus | B21D 53/04 29/890.039 |
| 2015/0075757 | A1 | 3/2015 | Blomgren et al. | |
| 2015/0369545 | A1 * | 12/2015 | Naritomi | F28F 13/06 29/890.03 |
| 2016/0265854 | A1 * | 9/2016 | Rice | F28D 9/0062 |

FOREIGN PATENT DOCUMENTS

| | | | |
|---|---|---|---|
| CN | 103958998 | A | 7/2014 |
| CN | 104204706 | A | 12/2014 |
| CN | 104180704 | B | 1/2016 |
| CN | 104197768 | B | 2/2016 |
| CN | 105466257 | A | 4/2016 |
| CN | 205607222 | U | 9/2016 |
| CN | 205784753 | U | 12/2016 |
| EP | 0165179 | B1 | 12/1985 |
| EP | 2508831 | A1 | 10/2012 |
| EP | 2597412 | A1 | 5/2013 |
| EP | 2647941 | A1 | 10/2013 |
| JP | 2003-501613 | A | 1/2003 |
| JP | 4097061 | B2 | 6/2008 |
| JP | 2014-533820 | A | 12/2014 |
| KR | 10-2014-0141624 | A | 12/2014 |
| WO | 9322608 | A1 | 11/1993 |
| WO | 0075591 | A1 | 12/2000 |
| WO | 2017/150975 | A1 | 9/2017 |

OTHER PUBLICATIONS

International Search Report (PCT/ISA/210) dated Nov. 30, 2018, by the European Patent Office as the International Searching Authority for International Application No. PCT/EP2018/073731.

Written Opinion (PCT/ISA/237) dated Nov. 30, 2018, by the European Patent Office as the International Searching Authority for International Application No. PCT/EP2018/073731.

Office Action dated Dec. 2, 2020, by the National Intellectual Property Administration, P. R. China in corresponding Chinese Patent Application No. 201880059697.6. (7 pages).

An English Translation of the Office Action (Notice of Reasons for Rejection) dated Apr. 19, 2021, by the Japanese Patent Office in corresponding Japanese Patent Application No. 2020-515115. (4 pages).

Compabloc-compact performance, https://www.alfalaval.com/globalassets/documents/products/heat-transfer/plate-heat-exchangers/welded-plate-and-block-heat-exchangers/product-brochure-compact-performance.pdf, (Mar. 20, 2005). (4 pages).

English Translation of the Third Office Action dated Dec. 3, 2021, by National Intellectual Property Administration, P.R. China in corresponding Chinese Patent Application No. 201880059697.6. (6 pages).

Office Action (Communication under Rule 71(3) EPC) dated Mar. 18, 2022, by the European Patent Office in corresponding European Patent Application No. 17 191 228.0-1002. (7 pages).

* cited by examiner

BAFFLE

TECHNICAL FIELD

The invention relates to a baffle for a block-type heat exchanger.

BACKGROUND ART

Today several different types of plate heat exchangers exist and are employed in various applications depending on their type. One certain type of plate heat exchanger is assembled by bolting a top head, a bottom head and four side panels to a set of corner girders to form a box-like enclosure around a stack of heat transfer or heat exchanging plates. This certain type of plate heat exchanger is referred to as a block-type heat exchanger. One example of a commercially available block-type heat exchanger is the heat exchanger offered by Alfa Laval AB under the product name Compabloc. Other block-type plate heat exchangers are disclosed in patent documents EP 165179 and WO 93/22608.

In the block-type plate heat exchanger fluid paths for two heat exchange fluids are formed between the heat transfer plates in the stack of heat transfer plates, in order to transfer heat between the two heat exchange fluids. Fluid inlets and fluid outlets are typically arranged on the side panels while baffles are attached to and arranged at the sides of the stack of heat transfer plates for directing a fluid back and forth through the fluid paths formed between heat transfer plates. The baffles are arranged in a space formed between the stack of heat transfer plates and the side panels. The corner girders are typically covered by girder linings protecting the corner girders from the heat exchange fluids. A so-called vacuum cage may be provided along the girder linings in the space formed between the stack of heat transfer plates and the side panels.

One type of baffle, which is employed in the above mentioned Compabloc heat exchanger, comprises two corrugated plates welded together. Each of the plates comprises a fold along one longitudinal edge of the baffle, which folds of the two plates together form a fork-like shape engaging the heat transfer plates. Each of the plates also comprises a fold along the opposite longitudinal edge of the baffle, which folds have been folded somewhat less than 90° for pressing and sealing against the side panel. Each of the plates also comprises folds along the transversal edges, which folds are welded to the girder lining or vacuum cage.

The existing baffles are heavy, expensive to manufacture and complicated to install and remove.

Hence, there is a need for an improved baffle.

SUMMARY

One object of the invention is to provide an improved baffle. One object of the invention is to improve the strength of a baffle. One object of the invention is to improve the stiffness of a baffle, One object of the invention is to improve the pressure resistance of a baffle. One object of the invention is to facilitate the manufacturing of a baffle. One object of the invention is to reduce the cost for a baffle. One object of the invention is to reduce the manufacturing cost of a baffle. One object of the invention is to reduce the weight of a baffle. One object of the invention is to reduce the material consumption of a baffle.

These and further objects are achieved by a baffle for a block-type heat exchanger. The baffle comprises a baffle plate. The baffle plate comprises a first surface and a second surface being parallel to a baffle plane located between the first surface and the second surface. The baffle plate comprises a first longitudinal edge, a second longitudinal edge, a first transverse edge and a second transverse edge. The baffle comprises a resilient member at the second longitudinal edge. The baffle comprises a reinforcement extending away from the baffle plane.

The reinforcement improves the strength, rigidity and stiffness of the baffle. The reinforcement simplifies and reduces the cost of manufacturing the baffle. The reinforcement reduces the necessary thickness of the baffle plate and the material consumption. The reinforcement enables a flat baffle plate and eliminates the need for corrugations. The baffle can be produced by bending a metal sheet and no pressing to obtain corrugations is necessary.

Still other objectives, features and advantages of the baffle will appear from the following detailed description as well as from the drawings.

BRIEF DESCRIPTION OF THE DRAWINGS

Embodiments of the invention will be described with reference to the accompanying schematic drawings, in which.

DETAILED DESCRIPTION

Figure 1:
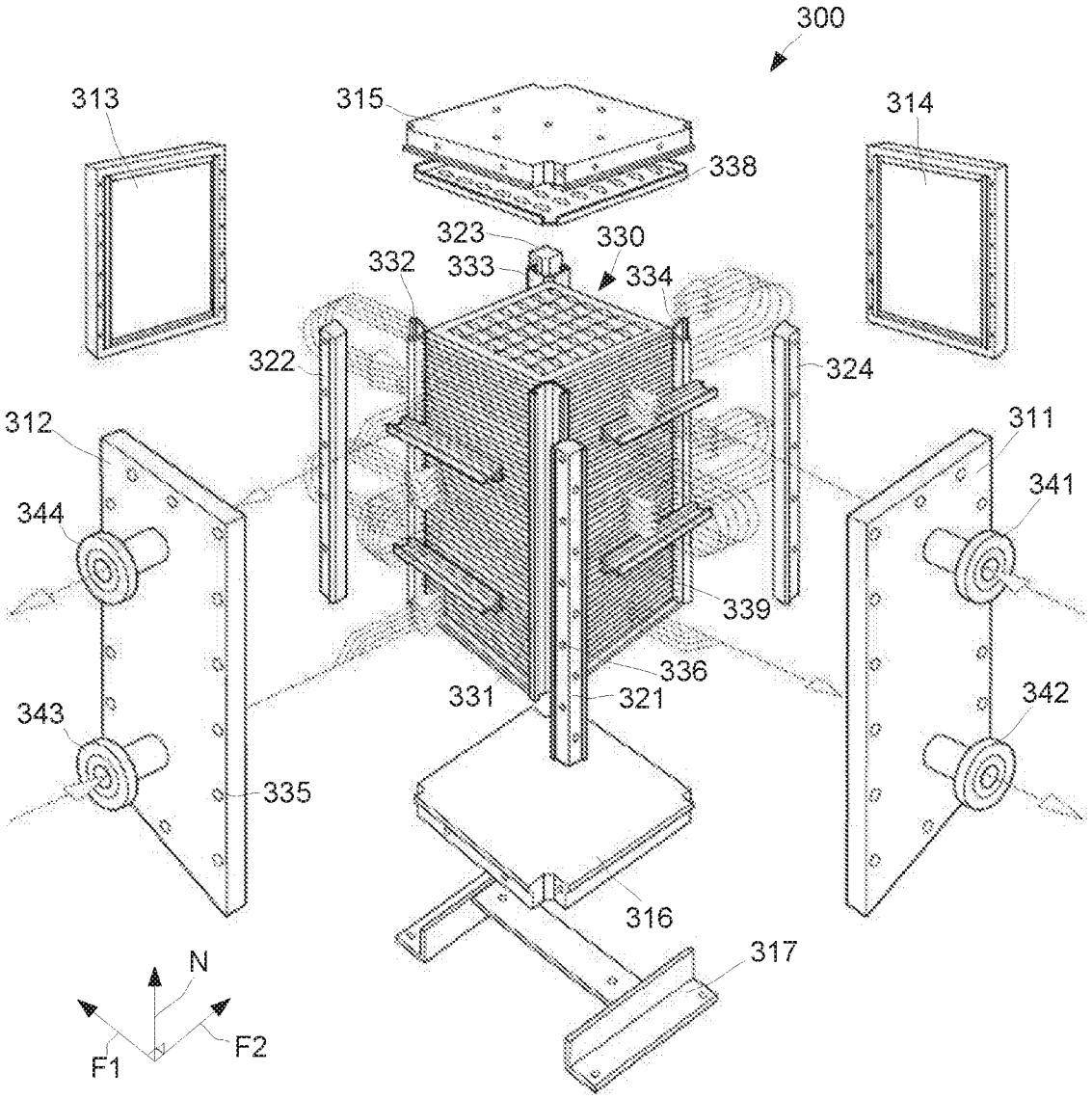
FIG. 1 is an exploded view of a block-type heat exchanger with baffles according to prior art.

With reference to FIG. 1 a plate heat exchanger 300 of a block-type having conventional baffles welded to girder linings is shown. The plate heat exchanger 300 comprises a top head 315, a bottom head 316 and four side panels 311, 312, 313, 314 that are bolted together with a set of four corner girders 321-324 for assembling the plate heat exchanger 300. When assembled, the plate heat exchanger 300 has a box-like or block-like shape and an enclosure is formed by the top head 315, the bottom head 316 and the side panels 311-314. A stack of heat transfer plates 330 is arranged within the enclosure and comprises a number of pairs of heat transfer plates. The stack of heat transfer plates 330 also has a box-like or block-like shape, which shape corresponds to the shape of the enclosure formed by the heads 315, 316 and the side panels 311-314. The stack of heat transfer plates 330 has at its corners four girder linings 331-334 that are arranged to face the corner girders 321-324. The plate heat exchanger 300 also has a base 317 that facilitates attachment of the plate heat exchanger 300 to the ground.

Gaskets (not shown) are arranged on the side panels 311-314 at sections that face the corner girders 321-324 and the heads 315, 316, such that the enclosure formed by the heads 315, 316 and side panels 311-314 is properly sealed for preventing leakage from the plate heat exchanger 300.

A first side panel 311 and a second side panel 312 of the side panels 311-314 comprise inlets and outlets for two fluids. In detail, the first side panel 311 has an inlet 341 and an outlet 342 for a first fluid. The inlet 341 and outlet 342 of the first panel 311 form a flow path for the first fluid in combination with the stack of heat transfer plates 330, where the flow path extends from the inlet 341, within the stack of heat transfer plates 330 and to the outlet 342. This flow path is illustrated by the broken arrows that extend in directions parallel to the direction F1. Baffles, such as conventional baffle 339, are connected to sides of the stack of heat transfer plates 330 for directing the flow of the first fluid in a number of passes within the stack 330 (four passes in the illustrated FIG. 1 having two baffles on each side).

The second side panel 312 has an inlet 343 and an outlet 344 for a second fluid. The inlet 343 and outlet 344 of the second side panel 312 form a flow path for the second fluid in combination with the stack of heat transfer plates 330, where the flow path extends from the inlet 343, within the stack of heat transfer plates 330 and to the outlet 344. This flow path is illustrated by the broken arrows that extend in directions parallel to the direction F2. Baffles, such as conventional baffles 333, connected to sides of the stack of heat transfer plates 330 direct the flow of the second fluid in a number of passes within the stack 330 (here the same number of passes as for the first fluid).

The first flow path for the first fluid is between the pairs of heat transfer plates in the stack 330, while the second flow path for the second fluid is within the pairs of heat transfer plates in the stack 330. A pair of heat transfer plates comprises a first heat transfer plate and a second heat transfer plate. This means that the flow of the first fluid is between heat transfer plates of different pairs of heat transfer plates, while the flow of the second fluid is between a first and a second heat transfer plate of the same pair, i.e. within a pair. The girder linings 331-334 seal the corners of the stack of heat transfer plates 330, which ensures that the two different fluids paths are separated.

The assembly of the plate heat exchanger 300 is typically performed by using conventional methods and bolts (not shown) that attach the mentioned components to each other via bolt holes like holes 335 and 336. In brief, assembling the plate heat exchanger 300 includes arranging the stack of heat transfer plates 330 on the bottom head 316, sliding the corner girders 321-324 into the girder linings 331-334 and bolting them to the bottom head 316. A channel end plate 338 is arranged on top of the stack of heat transfer plates 330 and the top head 315 is bolted to the corner girders 321-324. The baffles are attached to the girder linings. Thereafter the side panels 311-314 are bolted to the corner girders 321-324 and to the heads 315, 316.

Figure 2:
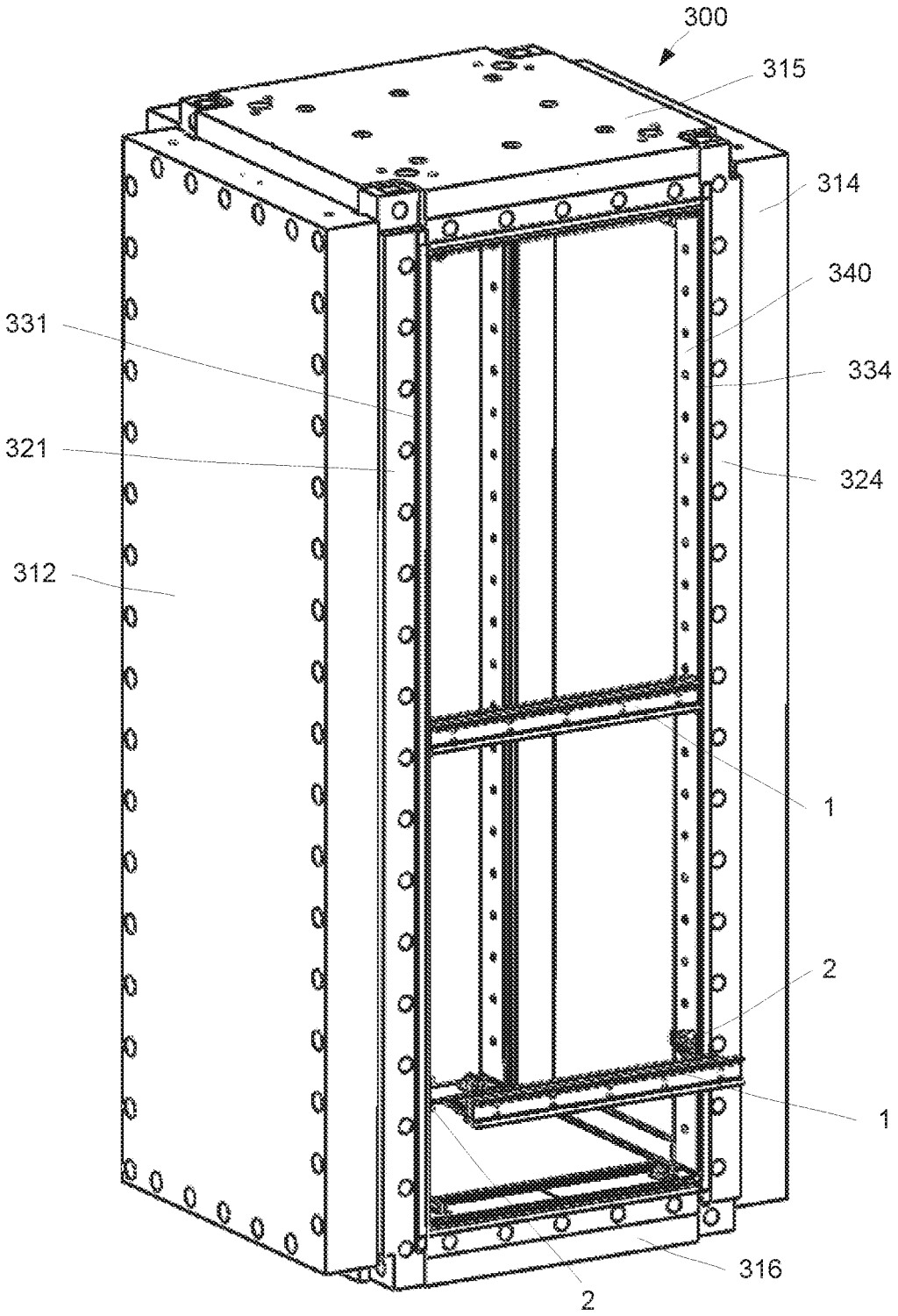
FIG. 2 is a perspective view of a block-type heat exchanger with an embodiment of baffle assemblies with a baffle and a baffle support according to the present invention.
Figure 3:
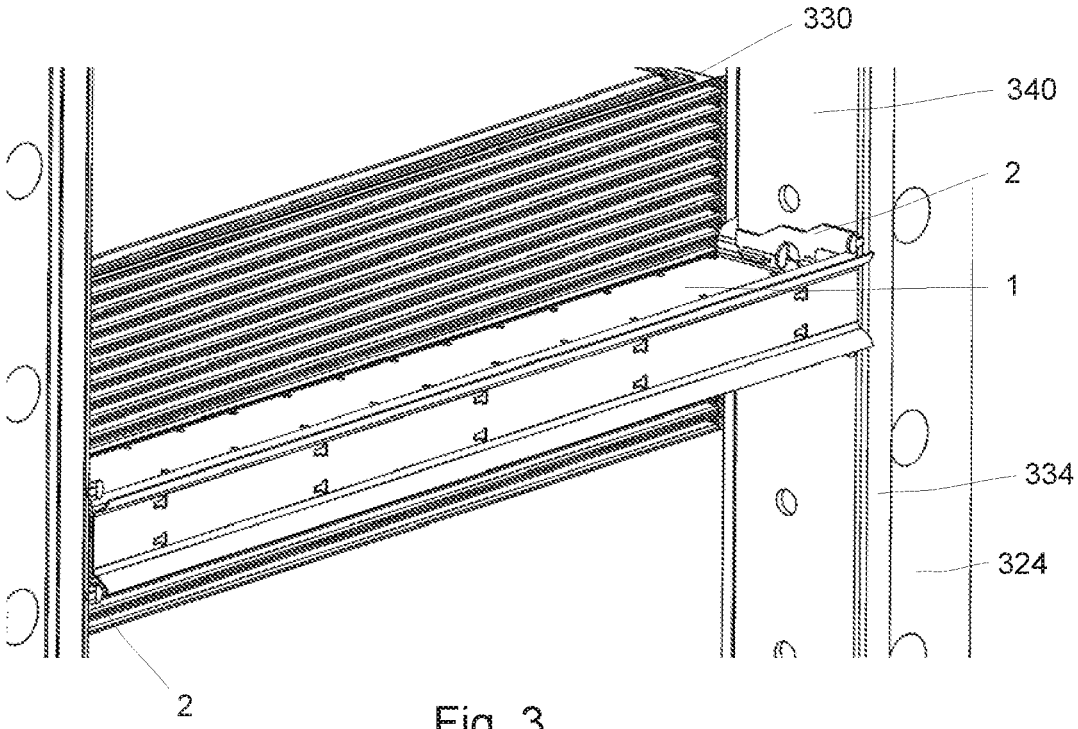
FIG. 3 is a perspective view of a detail of the block-type heat exchanger of FIG. 2 with the embodiment of a baffle assembly shown in FIG. 2.
Figure 4:
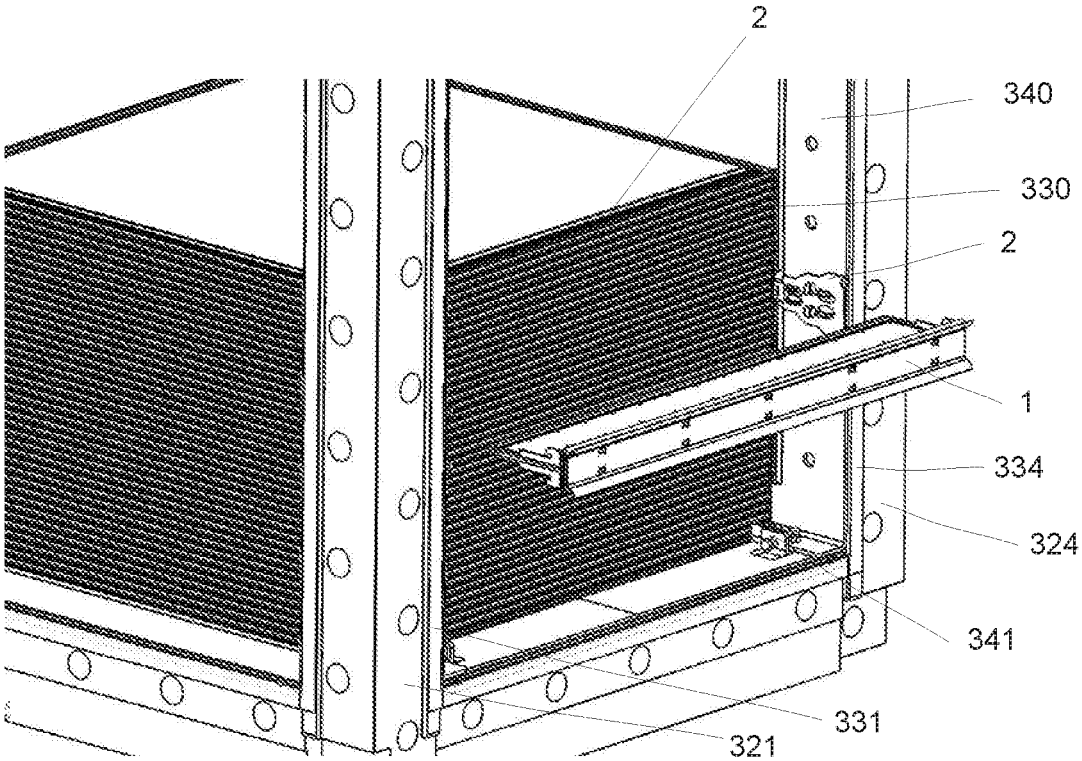
FIG. 4 is a perspective view of another detail of the block-type heat exchanger of FIG. 2 with the embodiment of a baffle assembly shown in FIG. 2, where the baffle is withdrawn from the baffle support.

Referring to FIGS. 2-4, a block-type plate heat exchanger of the type shown in FIG. 1, but with a new type of baffle assembly comprising a baffle 1 attached by means of baffle supports 2, is disclosed. In addition to the plate heat exchanger of FIG. 1, the plate heat exchanger of FIGS. 2-4 also discloses a vacuum cage 340 provided next to the girder linings (the girder linings 331, 334 as shown in the figures) in a space formed between the stack of heat transfer plates 330 and the side panel (the side panel 311 as shown in the figures). The space if defined by the stack of heat transfer plates 330, the side panel (the side panel 311 as shown in the figures) and the girder linings (the girder linings 331, 334 as shown in the figures). The vacuum cage 340 is fastened to the heads 315, 316 by fastening means 341.

In FIGS. 2-4, some of the heat transfer plates have been removed for better visibility. In FIG. 2 also the side panel 311 has been removed and the side panel 312 is shown without inlet 343 and outlet 344. In FIG. 4 all side panels have been removed.

Figure 5:
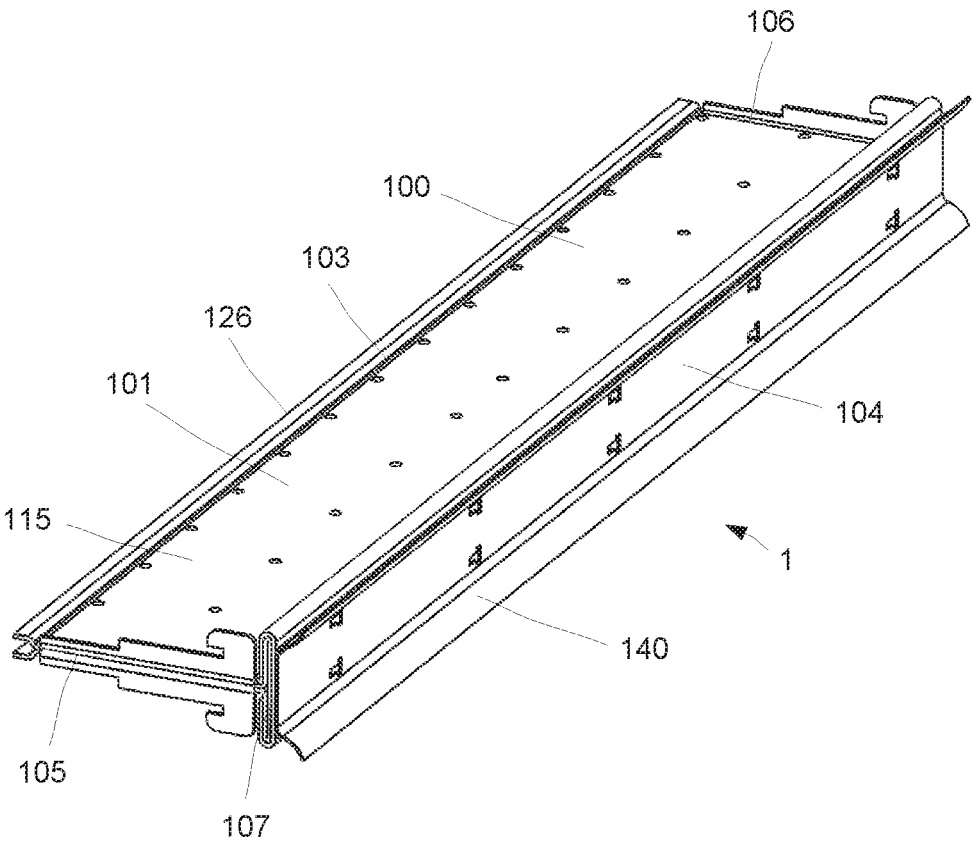
FIG. 5 is a perspective view of the embodiment of a baffle shown in FIGS. 2-4.
Figure 6:
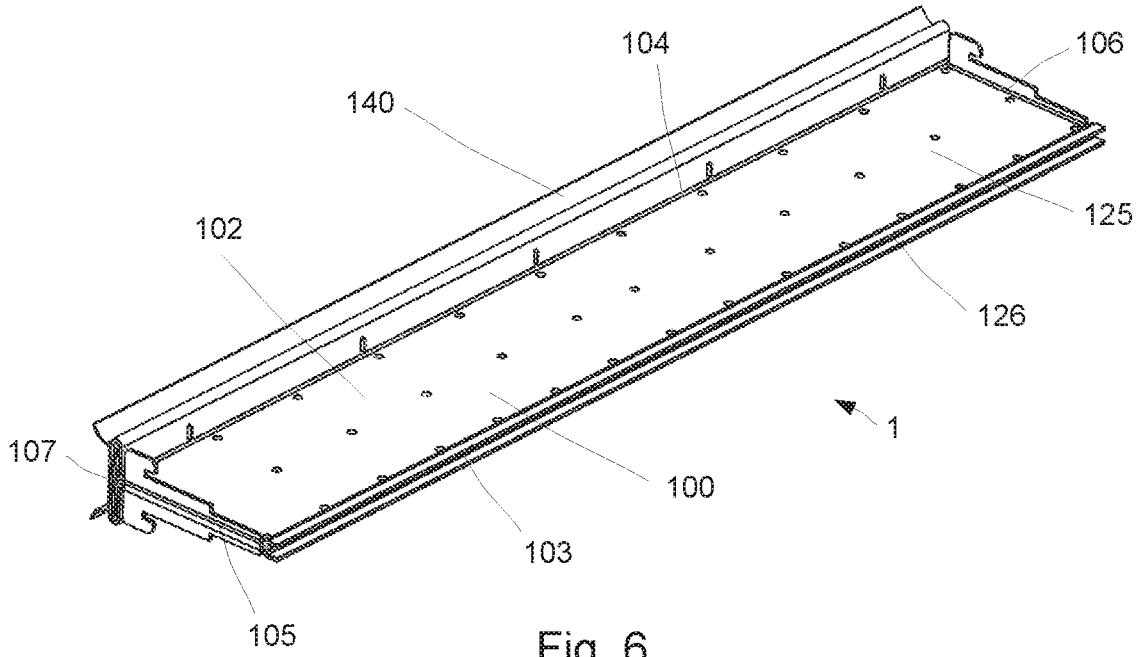
FIG. 6 is another perspective view of the embodiment of a baffle shown in FIGS. 2-5.
Figure 7:
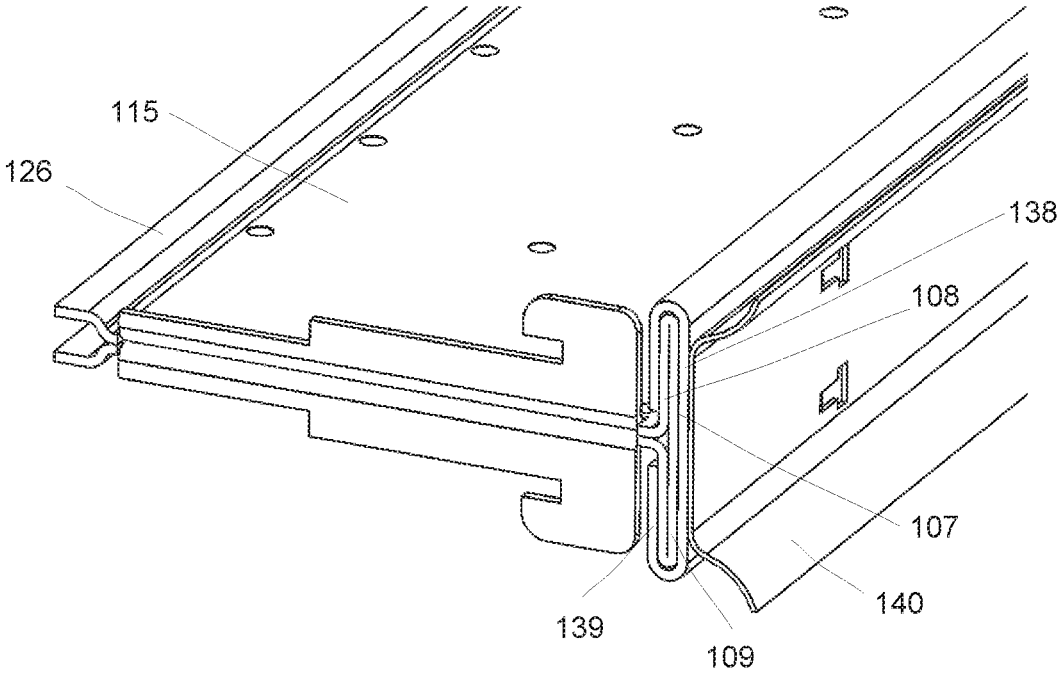
FIG. 7 is a perspective view of a detail of the embodiment of a baffle shown in FIGS. 2-6.
Figure 8:
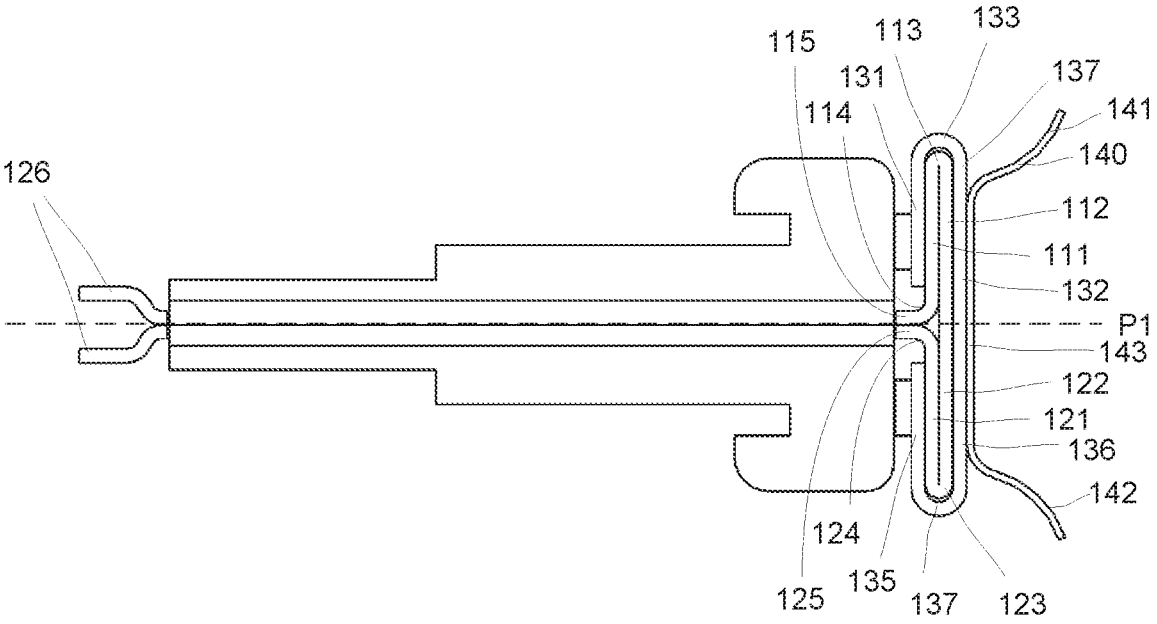
FIG. 8 is a side view of the embodiment of a baffle shown in FIGS. 2-7.

Referring to FIGS. 5-8, the baffle comprises a baffle plate 100. The baffle plate 100 comprises a first surface 101, which also can be denoted first baffle surface 101, and a second surface 102, which also can be denoted second baffle surface 102. FIG. 5 shows the upper side of the baffle, while FIG. 6 shows the lower side of the baffle.

The baffle plate 100 comprises a first sheet 115 and a second sheet 125. The first sheet 115 has the first surface 101 and the second sheet 125 has the second surface 102. The first surface 101 and the second surface 102 are facing in opposite directions. The first sheet 115 and the second sheet 125 are at least partially contacting each other. The first sheet 115 has a back surface on the opposite side of the first sheet 115 as the first surface 101 and the second sheet 125 has a back surface on the opposite side of the second sheet 125 as the second surface 102. The back surface of the first sheet 115 and the back surface of the second sheet 125 are facing each other and at least partly contacting each other. The first sheet 115 and the second sheet 125 are arranged parallel to and next to each other. The first sheet 115 and the second sheet 125 are parallel to a baffle plane P1 coinciding with the contacting plane between the first sheet 115 and the second sheet 125. The first sheet 115 and the second sheet 125 are welded, such as spot welded, to each other. The first sheet 115 and the second sheet 125 are at least in contact with each other at the locations of the spot welds.

The first surface 101 and the second surface 102 are parallel to the baffle plane P1. The baffle plane P1 is located between the first surface 101 and the second surface 102. The baffle plane P1 is parallel to the first surface 101 and the second surface 102.

The baffle plate 100 comprises a first longitudinal edge 103, a second longitudinal edge 104, a first transverse edge 105 and a second transverse edge 106. The first longitudinal edge 103 faces the stack of heat transfer plates 330. The second longitudinal edge 104 faces a side panel (the side panel 311 as shown in the figures, or any of the side panels 312, 313, 314 depending on on which side of the stack of heat transfer plates the baffle is mounted). The first transverse edge 105 faces a girder lining (the girder lining 331 as shown in the figures) and the second transverse edge 106 faces another girder lining (the girder lining 334 as shown in the figures). The first transverse edge 105 as well as the second transverse edge 106 connects the first longitudinal edge 103 with the second longitudinal edge 104.

The baffle comprises an engagement means 126 for engagement of the heat transfer plates. The engagement means is located at the first longitudinal edge 103. The engagement means is a fork-shaped or crotch-shaped portion 126. The engagement means is formed by bending the first sheet 115 and the second sheet 125 such that a fork-shaped portion 126 is formed together by the first and the second sheet. Consequently, each of the first sheet 115 and the second sheet 125 has a bend, which may be denoted fork bend, together forming a fork-shape for engaging the heat transfer plates. The fork-shaped portion 126 seals against the stack of heat transfer plates and prevents leakage between passes of the flow path.

The baffle comprises a reinforcement 107. The reinforcement 107 extends away from the baffle plane P1. The reinforcement 107 extends from the first surface 101 of the baffle plate 100. The reinforcement 107 comprises a primary double bent portion 108. The primary double bent portion 108 extends away from the baffle plane P1. The primary double bent portion 108 extends from the first surface 101. The double bent portion improves the strength, rigidity and stiffness of the baffle. The double bent portion simplifies and reduces the cost of manufacturing the baffle. The double bent portion reduces the necessary thickness of the baffle plate and the material consumption. The double bent portion enables a flat baffle plate and eliminates the need for corrugations.

The primary double bent portion 108 comprises a first primary bent portion 111 extending away from the baffle plane Pito a primary bend 113, which can be denoted first primary bend 113, located at a distance from the baffle plane P1. The first primary bent portion 111 extends from the first surface 101, The primary double bent portion 108 also comprises a second primary bent portion 112 extending from the first primary bend 113 towards the baffle plane P1. The first primary bend 113 is located at a distance from the baffle plane P1 as well as from the first surface 101. The first primary bent portion 111 and the second primary bent portion 112 are connected by the first primary bend 113. The primary double bent portion 108 is formed by bending a sheet at the location of the first primary bend 113 such that the first primary bent portion 111 and the second primary bent portion 112 together form a double bent portion. The first primary bent portion 111 as well as the second primary bent portion 112 themselves are preferably straight, but joined by the first primary bend 113 they together form a part of the primary double bent portion 108. The primary double bent portion 108 is formed from a sheet, i.e. a metal sheet. In particular, the first primary bent portion 111, the second primary bent portion 112 and the first primary bend 113 of the primary double bent portion 108 are formed from a sheet.

The reinforcement 107 extends away from the baffle plane P1 in two directions. This increases the strength and rigidity. The reinforcement 107 extends away from the baffle plane P1 in two substantially opposite directions. This is one version where one of the two directions has a component that extends away from the baffle plane P1 in a direction substantially opposite a direction in which a component of the other of the two directions extends away from the baffle plane P1, which in other words can be formulated such that one of the two directions has a component directed opposite a component of the other of the two directions, or in yet another wording such that one of the two directions has a component extending away from the baffle plane P1 in an opposite direction than a component of the other of the two directions. Said components, i.e. the oppositely directed components, of the two directions extend substantially perpendicular in relation to the baffle plane P1. The reinforcement 107 extends from the second surface 102 of the baffle plate 100. Thus, the reinforcement 107 extends from both the first surface 101 and the second surface 102 of the baffle plate 100. The reinforcement 107 comprises a secondary double bent portion 109. The secondary double bent portion 109 extends away from the baffle plane P1. The secondary double bent portion 109 extends away from the baffle plane P1 in a direction substantially opposite the direction in which the primary double bent portion 108 extends away from the baffle plane P1. The secondary double bent portion 109 extends from the second surface 102. The secondary double bent portion 109 comprises a first secondary bent portion 121 extending away from the baffle plane to a secondary bend 123, which can be denoted first secondary bend 123, located at a distance from the baffle plane P1. The first secondary bent portion 121 extends from the second surface 102. The first secondary bent portion 121 extends away from the baffle plane P1 in a direction substantially opposite the direction in which the first primary bent portion 111 extends away from the baffle plane P1. The first secondary bend 123 is located at an opposite side of the baffle plane P1 in relation to the location of the first primary bend 113. The secondary double bent portion 109 also comprises a second secondary bent portion 122 extending from the first secondary bend 123 towards the baffle plane P1. The first secondary bend 123 is located at a distance from the baffle plane P1 as well as from the second surface 102. The first secondary bent portion 121 and the second secondary bent portion 122 are connected by the first secondary bend 123. The secondary double bent portion 109 is formed by bending a sheet at the location of the first secondary bend 123 such that the first secondary bent portion 121 and the second secondary bent portion 122 together form a double bent portion. The first secondary bent portion 121 as well as the second secondary bent portion 122 themselves are preferably straight, but joined by the first secondary bend 123 they together form a part of the secondary double bent portion 109. The secondary double bent portion 109 is formed from a sheet, i.e. a metal sheet. In particular, the first secondary bent portion 121, the second secondary bent portion 122 and the first secondary bend 123 of the secondary double bent portion 109 are formed from a sheet. The primary double bent portion 108 comprises a second primary bend 114 from which the first primary bent portion 111 extends. The second primary bend 114 is located at the baffle plane P1. The second primary bend 114 implies that the primary double bent portion 108 is a portion of the first sheet 115, This facilitates and reduces the cost for manufacturing the baffle. The primary double bent portion 108 is formed by bending the first sheet 115 at the location of the second primary bend 114 and at the location of the first primary bend 113. The reinforcement 107 comprises a bent portion of the first sheet 115. As an alternative, the second primary bend 114 can be absent and the primary double bent portion 108 can be welded to the baffle plate 100, such as to the first sheet 115.

The secondary double bent portion 109 comprises a second secondary bend 124 from which the first secondary bent portion 121 extends. The second secondary bend 124 is located at the baffle plane P1. The second secondary bend 124 implies that the secondary double bent portion 109 is a portion of the second sheet 125, This facilitates and reduces the cost for manufacturing the baffle. The secondary double bent portion 109 is formed by bending the second sheet 125 at the location of the second secondary bend 124 and at the location of the first secondary bend 123. The reinforcement 107 also comprises a bent portion of the second sheet 125. As an alternative, the second secondary bend 124 can be absent and the secondary double bent portion 109 can be welded to the baffle plate 100, such as to the second sheet 125.

The reinforcement 107 extends substantially perpendicular in relation to the baffle plane P1. The reinforcement 107 extends substantially perpendicular from the first surface 101. The reinforcement 107 also extends substantially perpendicular from the second surface 102. The primary double bent portion 108 extends substantially perpendicular in relation to the baffle plane P1. The primary double bent portion 108 extends substantially perpendicular from the first surface 101. The secondary double bent portion 109 extends substantially perpendicular in relation to the baffle plane P1. The secondary double bent portion 109 extends substantially perpendicular from the second surface 102.

The first primary bent portion 111 extends substantially perpendicular in relation to the baffle plane P1. The first primary bent portion 111 extends substantially perpendicular from the first surface 101. The first primary bent portion 111 and the second primary bent portion 112 are substantially parallel, Thus, the second primary bent portion 112 extends substantially perpendicular in relation to the baffle plane P1, i.e. substantially perpendicular in relation to the first surface 101.

The first secondary bent portion 121 extends substantially perpendicular in relation to the baffle plane P1. The first secondary bent portion 121 extends substantially perpendicular from the second surface 102. The first secondary bent portion 121 and the second secondary bent portion 122 are substantially parallel. Thus, the second secondary bent portion 122 extends substantially perpendicular in relation to the baffle plane P1, i.e. substantially perpendicular in relation to the second surface 102.

The second primary bent portion 112 and the second secondary bent portion 122 are joined. Thereby the strength and stiffness is increased. The second primary bent portion 112 and the second secondary bent portion 122 may be joined at the baffle plane P1. The second primary bent portion 112 and the second secondary bent portion 122 may be joined by a weld or by being made from a common sheet. In the embodiment shown in the drawings, the second primary bent portion 112 and the second secondary bent portion 122 are joined by being made from a common sheet. The second primary bent portion 112 and the second secondary bent portion 122 are integrated. The second primary bent portion 112 and the second secondary bent portion 122 are a common second bent portion 112, 122, The common second bent portion extends from the first primary bend 113 to the first secondary bend 123. The second primary bent portion 112 and the second secondary bent portion 122 are made from a common sheet. Thus, the primary double bent portion 108 and the secondary double bent portion 109 are made from a common sheet. In particular, the first primary bent portion 111, the second primary bent portion 112 and the first primary bend 113 of the primary double bent portion 108 and the first secondary bent portion 121, the second secondary bent portion 122 and the first secondary bend 123 of the secondary double bent portion 109 are formed from a common sheet.

The first sheet 115 and the second sheet 125 are joined. In particular, the first sheet 115 and the second sheet 125 are joined by the joinder of the second primary bent portion 112 and the second secondary bent portion 122 and by the presence of the second primary bend 114 and the second secondary bend 124. The first sheet 115 and the second sheet 125 may be joined by a weld or formed from a common sheet, similarly as described for the joinder of the second primary bent portion 112 and the second secondary bent portion 122. The first sheet 115 and the second sheet 125 are integrated. The first sheet 115 are the second sheet 125 are preferably formed from a common main sheet. Preferably, the first sheet 115, the second sheet 125, the second primary bend 114, the second secondary bend 124, the first primary bent portion 111, the first secondary bent portion 121, the first primary bend 113, the first secondary bend 123, the second primary bent portion 112 and the second secondary bent portion 122 are formed from a common main sheet. The baffle plate 100, the primary double bent portion 108 and the secondary double bent portion 109 are preferably made by bending a common main sheet at the locations of the second primary bend 114, the first primary bend 113, the first secondary bend 123 and the second secondary bend 124.

The reinforcement 107 is located at the second longitudinal edge 104, i.e. the longitudinal edge facing a side panel (the side panel 311 as shown in the figures). The reinforcement 107 extends along at least a majority of the second longitudinal edge 104, preferably along at least 80% of the second longitudinal edge, more preferred along at least 90% of the second longitudinal edge, and most preferred along substantially all of the second longitudinal edge 104.

The baffle plate 100 is substantially flat. The first sheet 115 and the second sheet 125 are substantially flat. Since the baffle plate 100 as well as the first sheet 115 and the second sheet 125 forming the baffle plate 100 are flat, none of these have any corrugation. The reinforcement 107 increases the strength and stiffness of the baffle plate 100 and eliminates the need for a corrugation.

The reinforcement 107 comprises an additional reinforcement 130 covering the primary double bent portion 108. The additional reinforcement 130 increases the strength and stiffness of the baffle. The additional reinforcement 130 comprises a first primary additional portion 131 extending along the first primary bent portion 111 to a primary additional bend 133 covering the first primary bend 113, The additional reinforcement 130 comprises a second primary additional portion 132 extending from the primary additional bend 133 along the second primary bent portion 112. The first primary additional portion 131 extends along at least a majority of the first primary bent portion 111, The second primary additional portion 132 extends along at least a majority of the second primary bent portion 112, preferably along the complete second primary bent portion 112. The additional reinforcement 130 comprises a primary additional double bent portion 138. The primary additional double bent portion 138 comprises the first primary additional portion 131, the second primary additional portion 132 and the primary additional bend 133.

The additional reinforcement 130 also covers the secondary double bent portion 109. The additional reinforcement 130 comprises a first secondary additional portion 135 extending along the first secondary bent portion 121 to a secondary additional bend 137 covering the first secondary bend 123. The additional reinforcement 130 comprises a second secondary additional portion 136 extending from the secondary additional bend 137 along the second secondary bent portion 122, The first secondary additional portion 135 extends along at least a majority of the first secondary bent portion 121. The second secondary additional portion 136 extends along at least a majority of the second secondary bent portion 122, preferably along the complete second secondary bent portion 122. The additional reinforcement 130 comprises a secondary additional double bent portion 139. The secondary additional double bent portion 139 comprises the first secondary additional portion 135, the second secondary additional portion 136 and the secondary additional bend 137.

The primary additional double bent portion 138 is formed by bending a sheet at the location of the primary additional bend 133 such that the first primary additional portion 131 and the second primary additional portion 132 together form a double bent portion. The first primary bent portion 111 and the second primary bent portion 112 of the primary double bent portion 108 are located between the first primary additional portion 131 and the second primary additional portion 132 of the primary additional double bent portion 138. The first primary additional portion 131 as well as the second primary additional portion 132 themselves are preferably straight, but joined by the primary additional bend 133 they together form a part of the primary additional double bent portion 138. The primary additional double bent portion 138 is formed from a sheet, i.e. a metal sheet. In particular, the first primary additional portion 131, the second primary additional portion 132 and the primary additional bend 133 of the primary additional double bent portion 138 are formed from a sheet.

The secondary additional double bent portion 139 is formed by bending a sheet at the location of the secondary additional bend 137 such that the first secondary additional portion 135 and the second secondary additional portion 136 together form a double bent portion. The first secondary bent portion 121 and the second secondary bent portion 122 of the secondary double bent portion 109 are located between the first secondary additional portion 135 and the second secondary additional portion 136 of the secondary additional double bent portion 139. The first secondary additional portion 135 as well as the second secondary additional portion 136 themselves are preferably straight, but joined by the secondary additional bend 137 they together form a part of the secondary additional double bent portion 139. The secondary additional double bent portion 139 is formed from a sheet, i.e. a metal sheet. In particular, the first secondary additional portion 135, the second secondary additional portion 136 and the secondary additional bend 137 of the secondary additional double bent portion 139 are formed from a sheet.

The second primary additional portion 132 and the second secondary additional portion 136 are joined. Thereby, the strength and stiffness of the baffle is increased. The second primary additional portion 132 and the second secondary additional portion 136 may be joined by a weld or by being made from a common sheet. In the embodiment shown in the drawings, the second primary additional portion 132 and the second secondary additional portion 136 may be joined by being made from a common sheet. The second primary additional portion 132 and the second secondary additional portion 136 are integrated.

The second primary additional portion 132 and the second secondary additional portion 136 are a common second additional portion 132, 136. The common second additional portion 132, 136 extends from the primary additional bend 133 to the secondary additional bend 137. The second primary additional portion 132 and the second secondary additional portion 136 are made from a common sheet. Thus, the primary additional double bent portion 138 and the secondary additional double bent portion 139 are made from a common additional sheet 134. In particular, the first primary additional portion 131, the second primary additional portion 132 and the primary additional bend 133 of the primary additional double bent portion 138 and the first secondary additional portion 135, the second secondary additional portion 136 and the secondary additional bend 137 of the secondary additional double bent portion 139 are formed from a common additional sheet 134. Thereby, the reinforcement 107 comprises an additional sheet 134. The additional sheet 134 comprises the additional reinforcement 130.

The baffle comprises a resilient member 140 at the second longitudinal edge 104. The resilient member 140 resiliently abuts the side panel (the side panel 311 as shown in the figures). Thereby, the resilient member 140 seals against the side panel and prevents flow past the baffle and between the passes of the heat exchanger. The resilient member secures that the baffle is pushed adequately against the baffle support and is held in an appropriate position. The resilient member 140 is attached to the reinforcement 107. The resilient member 140 is attached to the additional reinforcement 130 by means of welding, such as spot welding, or by fastening means, such as clips or protuberances extending from the resilient member through holes in the double bent portions 108, 109, 138, 139 as seen in the FIGS. 5-8. A portion 141, 142 of the resilient member 140 extends in a direction having at least a component being parallel to the baffle plane P1 and perpendicular to the second longitudinal edge 104. Preferably, a portion 141, 142 of the resilient member 140 extends in a direction having a component being parallel to the baffle plane P1 and perpendicular to the second longitudinal edge 104 and a component being perpendicular to the baffle plane P1. The resilient member 140 comprises a resilient fin 141, 142. The resilient fin 141, 142 abuts the side panel. The fin 141, 142 extends in a direction having at least a component being parallel to the baffle plane P1 and perpendicular to the second longitudinal edge 104. Preferably, the fin 141, 142 extends in a direction having at least a component being parallel to the baffle plane P1 and perpendicular to the second longitudinal edge 104 and a component being perpendicular to the baffle plane P1. The resilient member 140 comprises two resilient fins 141, 142, as shown in the FIGS. 2-8. Each fin 141, 142 extends in a direction having at least a component being parallel to the baffle plane P1 and perpendicular to the second longitudinal edge 104. The resilient member 140 comprises a primary resilient fin 141 extending in a direction having a component being parallel to the baffle plane P1 and perpendicular to the second longitudinal edge 104 and a component being perpendicular to the baffle plane P1 and extending away from the first baffle surface 101. The resilient member 140 comprises a secondary resilient fin 141 extending in a direction having a component being parallel to the baffle plane P1 and perpendicular to the second longitudinal edge 104 and a component being perpendicular to the baffle plane P1 and extending away from the second baffle surface 102.

The resilient member comprises a mid-portion 143. The mid-portion 143 connects the fins 141, 142. The mid-portion 143 is attached to the reinforcement 107. The mid-portion 143 is attached to the additional reinforcement 130, in particular to the second primary additional portion 132 and the second secondary additional portion 136. The mid-portion 143 is flat. The mid-portion extends along the second primary bent portion 112 and the second secondary bent portion 122. The mid-portion 143 is parallel to the second primary bent portion 112 and the second secondary bent portion 122.

The resilient member 140 extends along at least a majority of the second longitudinal edge 104, preferably along at least 80% of the second longitudinal edge, more preferred along at least 90% of the second longitudinal edge, and most preferred along substantially all of the second longitudinal edge 104.

Figure 9:
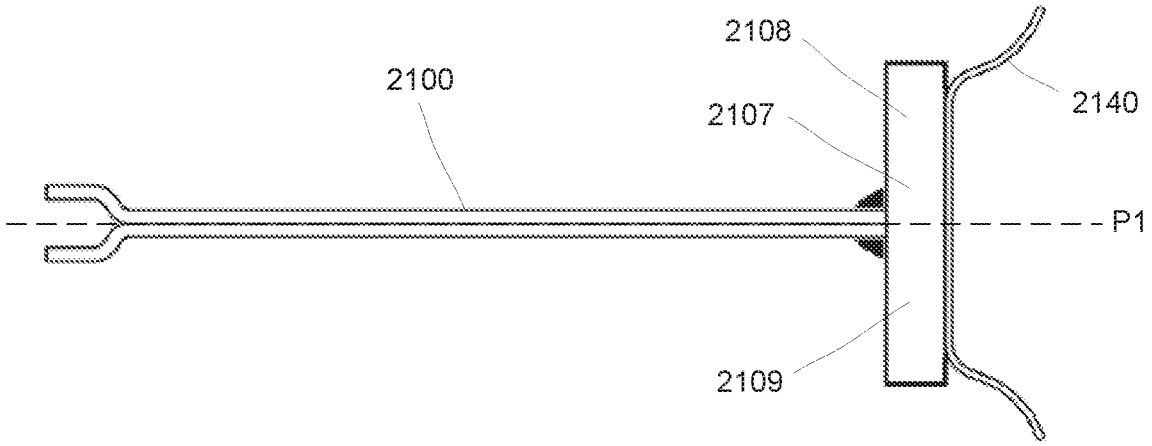
FIG. 9 is a side view of a second embodiment of a baffle according to the invention.
Figure 10:
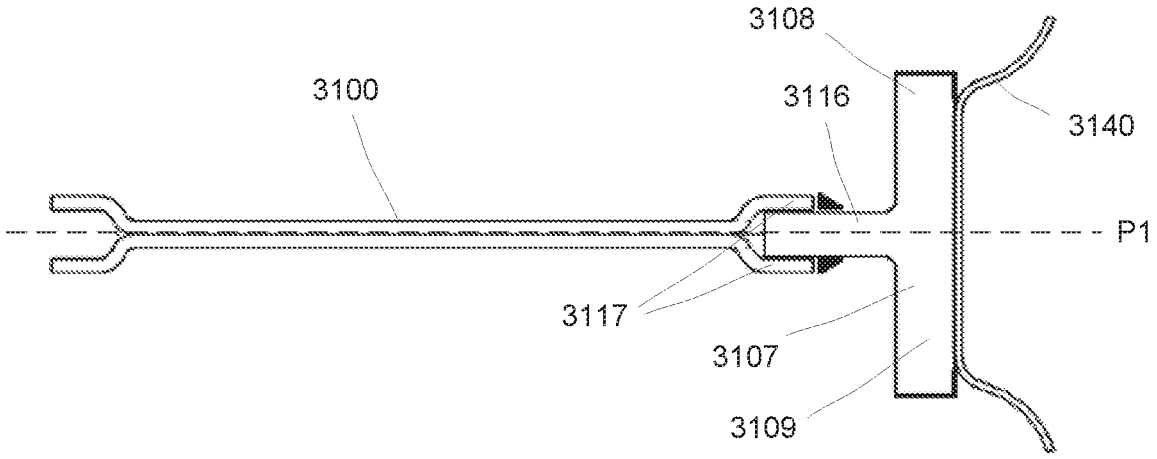
FIG. 10 is a side view of a third embodiment of a baffle according to the invention.
Figure 11:
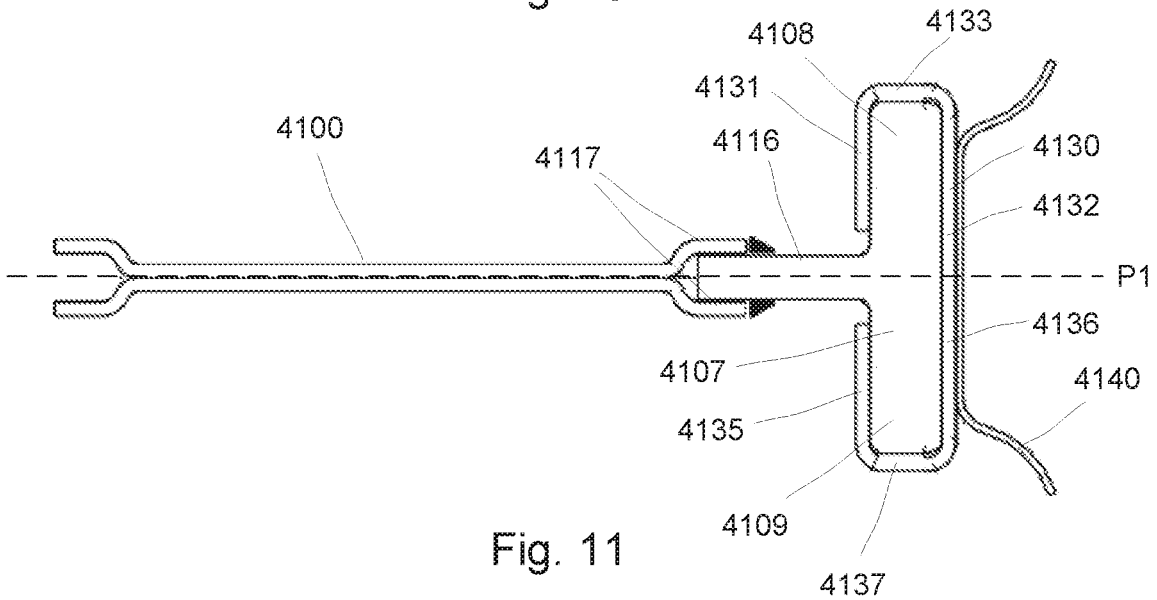
FIG. 11 is a side view of a fourth embodiment of a baffle according to the invention.
Figure 12:
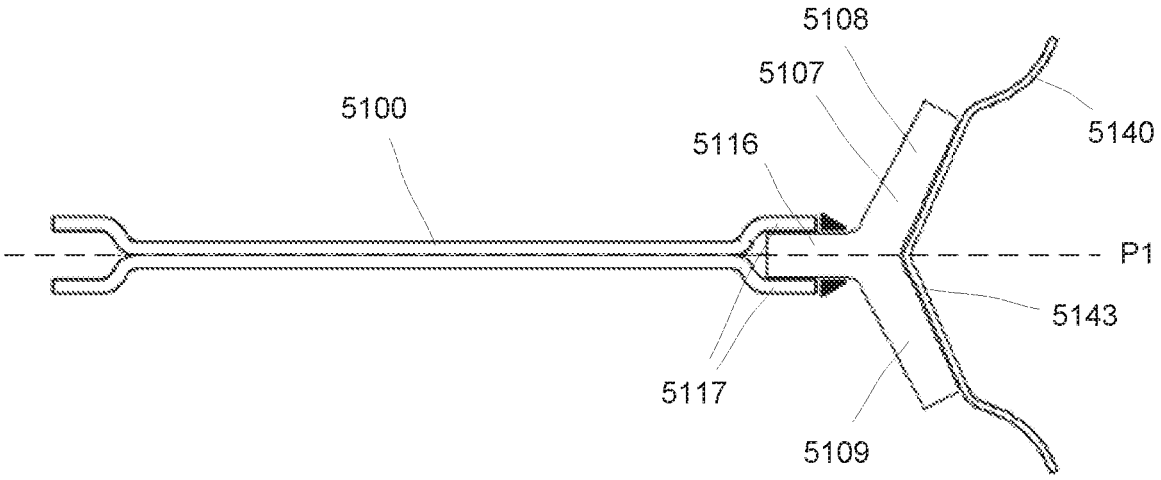
FIG. 12 is a side view of a fifth embodiment of a baffle according to the invention.
Figure 13:
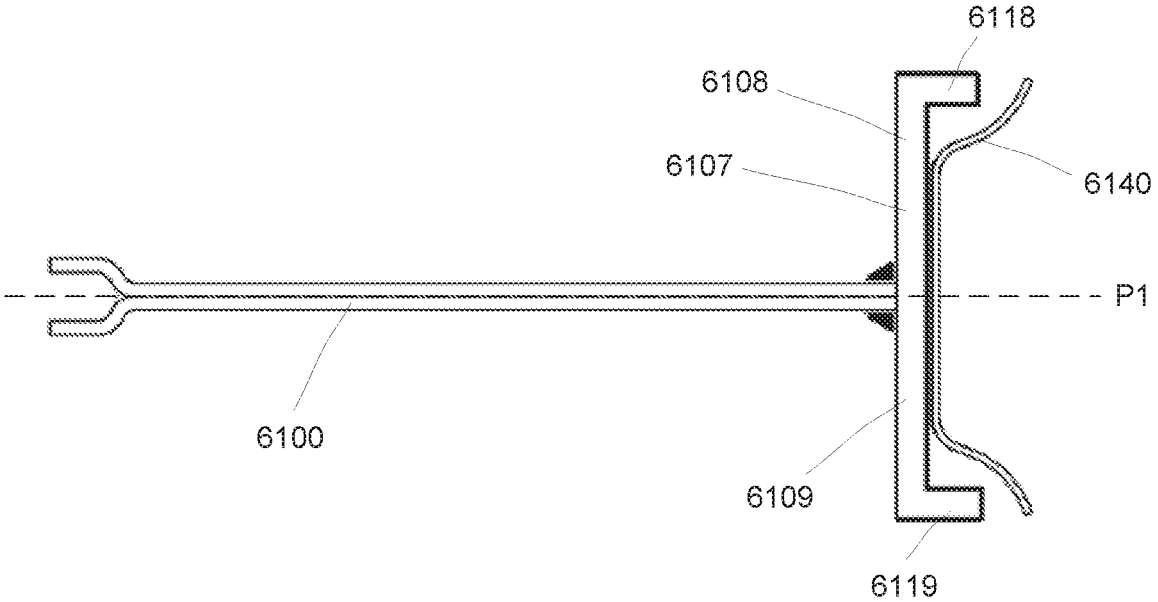
FIG. 13 is a side view of a sixth embodiment of a baffle according to the invention.

Referring to FIG. 9, a second embodiment of a baffle having a reinforcement 2107 is disclosed. Referring to FIG. 10, a third embodiment of a baffle having a reinforcement 3107 is disclosed. Referring to FIG. 11, a fourth embodiment of a baffle having a reinforcement 4107 is disclosed. Referring to FIG. 12, a fifth embodiment of a baffle having a reinforcement 5107 is disclosed. Referring to FIG. 13, a sixth embodiment of a baffle having a reinforcement 6107 is disclosed. In all these embodiments, the reinforcement 2107, 3107, 4107, 5107, 6107 extends away from the baffle plane P1.

The reinforcement 2107, 3107, 4107, 5107, 6107 comprises a primary portion 2108, 3108, 4108, 5108, 6108 extending away from the baffle plane P1. The reinforcement 2107, 3107, 4107, 5107, 6107 extends away from the baffle plane P1 in two directions. The reinforcement 2107, 3107, 4107, 5107, 6107 comprises a secondary portion 2109, 3109, 4109, 5109, 6109 extending away from the baffle plane P1.

The reinforcement 2107, 3107, 4107, 5107, 6107 extends away from the baffle plane P1 in two directions, where one of the two directions has a component that extends away from the baffle plane P1 in a direction substantially opposite a direction in which a component of the other of the two directions extends away from the baffle plane P1. In other words, where one of the two directions has a component directed opposite a component of the other of the two directions, or in yet another wording where one of the two directions has a component extending away from the baffle plane P1 in an opposite direction than a component of the other of the two directions. The reinforcement 2107, 3107, 4107, 5107, 6107 extends from a first surface of the baffle plate 2100, 3100, 4100, 6100. The reinforcement 2107, 3107, 4107, 5107, 6107 extends from a second surface of the baffle plate 2100, 3100, 4100, 6100. Thus, the reinforcement 2107, 3107, 4107, 5107 6107 extends from both the first surface and the second surface of the baffle plate 2100, 3100, 4100, 6100. Said components, i.e. the oppositely directed components, of the two directions extend substantially perpendicular in relation to the baffle plane P1.

In the second, third, fourth and sixth embodiment (see FIGS. 9, 10, 11 and 13) the reinforcement 2107, 3107, 4107, 6107 extends away from the baffle plane P1 in two substantially opposite directions. The reinforcement 2107, 3107, 4107, 6107 extends from a first surface of the baffle plate 2100, 3100, 4100, 6100. The reinforcement 2107, 3107, 4107, 6107 extends from a second surface of the baffle plate 2100, 3100, 4100, 6100. Thus, the reinforcement 2107, 3107, 4107, 6107 extends from both the first surface and the second surface of the baffle plate 2100, 3100, 4100, 6100. In these embodiments, the reinforcement 2107, 3107, 4107, 6107 extends substantially perpendicular in relation to the baffle plane P1. The secondary portion 2109, 3109, 4109, 6109 extends away from the baffle plane P1 in a direction substantially opposite the direction in which the primary portion 2108, 3108, 4108, 6108 extends away from the baffle plane P1. The primary portion 2108, 3108, 4108, 6108 extends substantially perpendicular in relation to the baffle plane P1. The secondary portion 2109, 3109, 4109, 6109 extends substantially perpendicular in relation to the baffle plane P1.

In the fifth embodiment (see FIG. 12), the primary portion 5108 is inclined in relation to the baffle plane P1. The secondary portion 5109 is inclined in relation to the baffle plane P1. The primary portion 5108 is inclined such that the primary portion 5108 points away from the first longitudinal edge 103. The secondary portion 5109 is inclined such that the secondary portion 5109 points away from the first longitudinal edge 103. An angle being smaller than 90° is formed between the primary portion 5108 and the secondary portion 5109 on the side of the reinforcement 5107 facing away from the baffle plate 5100.

In all these five embodiments (see FIGS. 9-13), the reinforcement 2107, 3107, 4107, 5107, 6107 is welded to the baffle plate 2100, 3100, 4100, 5100, 6100. In the second and sixth embodiment (see FIGS. 9 and 13), the reinforcement 2107, 6107 is directly welded to the baffle plate 2100, 6100. In the third, fourth and fifth embodiment (see FIGS. 10, 11 and 12), the reinforcement 3107, 4107, 5107 comprises an attachment portion 3116, 4116, 5116. The attachment portion 3116, 4116, 5116 extends in direction of the baffle plate 3100, 4100, 5100. The attachment portion 3116, 4116, 5116 engages a further fork-shaped portion 3117, 4117, 5117 of the baffle plate 3100, 4100, 5100. The attachment portion 3116, 4116, 5116 is welded to the further fork-shaped portion 3117, 4117, 5117.

In the fourth embodiment, the reinforcement 4107 comprises an additional reinforcement 4130, which is similar to the additional reinforcement 130 of the first embodiment described above. The additional reinforcement 4130 covers the primary portion 4108. The additional reinforcement 4130 covers the secondary portion 4109. The additional reinforcement 4130 comprises a first primary additional portion 4131 extending along the side of the primary portion 4108 facing the baffle plate 4100 to a primary additional bend 4133 covering the end of the primary portion 4108. The additional reinforcement 4130 comprises a second primary additional portion 4132 extending from the primary additional bend 4133 along the side of the primary portion 4108 facing away from the baffle plate 4100, i.e. towards the baffle plane P1. The additional reinforcement 4130 comprises a first secondary additional portion 4135 extending along the side of the secondary portion 4109 facing the baffle plate 4100 to a secondary additional bend 4137 covering the end of the secondary portion 4109. The additional reinforcement 4130 comprises a second secondary additional portion 4136 extending from the secondary additional bend 4137 along the side of the secondary portion 4109 facing away from the baffle plate 4100, i.e. towards the baffle plane P1. The second primary additional portion 4132 and the second secondary additional portion 4136 are joined, preferably by being made from a common sheet.

In the sixth embodiment (see FIG. 13), the primary portion 6108 comprises a primary hook 6118 facing away from the baffle plate 6100. The primary hook 6118 is located at an end of the primary portion 6108. The secondary portion 6109 comprises a secondary hook 6119 facing away from the baffle plate 6100. The secondary hook 6119 is located at an end of the secondary portion 6109.

In all these embodiments (see FIGS. 9, 10, 11, 12 and 13), a resilient member 2140, 3140, 4140, 5140, 6140 as disclosed above is attached to the reinforcement 2107, 3107, 4107, 5107, 6107. The only difference is that in the fifth embodiment (see FIG. 12), the mid-portion 5143 has a flexion.

In the first embodiment of a baffle shown in FIGS. 5-8, the reinforcement 107 may at least partly be integrated with the baffle plate 100, while in the second, third, fourth, fifth and sixth embodiments shown in FIGS. 9, 10, 11, 12 and 13, respectively, the reinforcement 2107, 3107, 4107, 5107, 6107 is a separate piece connected to the baffle plate 100.

The baffle 1 may be held by two baffle supports 2. Each baffle support 2 is attached to an inner side wall. The inner side wall is a side wall of the space formed between the stack of heat transfer plates 330 and the side panel (the side panel 311 as shown in the figures). The inner side wall comprises the girder linings (the girder linings 331, 334 as shown in the figures). The baffle support 2 may be directly attached to the girder linings (the girder linings 331, 334 as shown in the figures) by welding or by fastening means such as bolts or screws fastened to the girder linings (the girder linings 331, 334 as shown in the figures) or the girders (the girders 321, 324 as shown in the figures). Alternatively, the baffle support 2 may be indirectly attached to the girder linings (the girder linings 331, 334 as shown in the figures). The baffle support may be attached to a vacuum cage 340 provided next to the girder lining in the space between the stack of heat transfer plates 330 and the side panel (the side panel 311 as shown in the figures) by welding or by fastening means.

The baffle 1 may alternatively be attached to the inner side wall by welding. The baffle 1 may be attached to the inner side wall without a baffle support. The baffle may be directly attached to the to the girder linings by welding or by fastening means such as bolts or screws fastened to the girder linings or the girders. Alternatively, the baffle 1 may be indirectly attached to the girder linings, such as to the vacuum cage 340 by welding or by fastening means.

A block-type heat exchanger may have two or more baffles on one side of the stack of heat transfer plates as shown in FIG. 2. One, two or more similar baffles may be arranged on other sides, preferably the opposite side, and more preferred all sides, of the stack of heat transfer plates in the same way as is visualized in FIG. 1.

The baffle 1 itself as well as the reinforcement 107, the fork-shaped portion 126 and the resilient member 140 are symmetrical with a mirror plane coinciding with the baffle plane P1. The baffle is also symmetrical with a mirror plane extending from a midpoint of the first longitudinal edge 103 to a midpoint of the second longitudinal edge 104 and being perpendicular to the baffle plane P1.

The foregoing has described the principles, preferred embodiments, aspects and modes of operation of the present invention. However, the description should be regarded as illustrative rather than restrictive, and the invention should not be limited to the particular embodiments and versions discussed above. The different features of the various embodiments and versions of the invention can be combined in other combinations than those explicitly described. It should therefore be appreciated that variations may be made in those embodiments and versions by those skilled in the art without departing from the scope of the present invention as defined by the following claims.

The invention claimed is:

1. A baffle to be mounted on a heat transfer plate forming part of a block-type heat exchanger in which side panels form an enclosure configured to have arranged therein the heat transfer plate and the baffle, the baffle comprising:

a baffle plate, the baffle plate comprising;

a first surface and a second surface being parallel to a baffle plane located between the first surface and the second surface;

a first longitudinal edge, a second longitudinal edge, a first transverse edge and a second transverse edge;

a reinforcement to improve strength of the baffle, the reinforcement being fixed to the baffle plate, extending along the second longitudinal edge of the baffle plate and extending away from the baffle plane, the reinforcement including an outer surface;

a resilient member for resiliently abutting and sealing against one of the side panels when the heat transfer plate and the baffle are arranged in the enclosure, the resilient member being attached to the reinforcement and extending along the reinforcement.

2. A baffle according to claim 1, wherein the reinforcement is located at the second longitudinal edge.

3. A baffle according to claim 1, wherein a portion of the resilient member extends in a direction having at least a component being parallel to the baffle plane and perpendicular to the second longitudinal edge.

4. A baffle according to claim 1, wherein the reinforcement extends away from the baffle plane in two directions.

5. A baffle according to claim 1, wherein the reinforcement comprises a primary double bent portion comprising a first primary bent portion extending away from the baffle plane to a first primary bend located at a distance from the baffle plane and a second primary bent portion extending from the first primary bend towards the baffle plane.

6. A baffle according to claim 5, wherein the reinforcement comprises a secondary double bent portion comprising a first secondary bent portion extending away from the baffle plane to a first secondary bend located at a distance from the baffle plane and a second secondary bent portion extending from the first secondary bend towards the baffle plane.

7. A baffle according to claim 5, wherein the primary double bent portion comprises a second primary bend from which the first primary bent portion extends.

8. A baffle according to claim 6, wherein the second primary bent portion and the second secondary bent portion are joined.

9. A baffle according to claim 5, wherein the baffle plate comprises a first sheet and a second sheet at least partially contacting each other, the first sheet having the first surface and the second sheet having the second surface.

10. A baffle according to claim 9, wherein the reinforcement comprises a bent portion of the first sheet.

11. A baffle according to claim 5, wherein the first primary bent portion extends substantially perpendicular in relation to the baffle plane.

12. A baffle according to claim 5, wherein the first primary bent portion and the second primary bent portion are substantially parallel.

13. A baffle according to claim 5, wherein the reinforcement comprises an additional reinforcement covering the primary double bent portion.

14. A baffle according to claim 1, wherein the reinforcement extends along at least a majority of the second longitudinal edge.

15. A baffle according to claim 1, wherein the reinforcement extends away from the baffle plane: i) in a first direction and a second direction, the first direction having a component that extends away from the baffle plane P1 in a direction substantially opposite a direction in which a component of the second direction extends away from the baffle plane P1; or ii) in two substantially opposite directions.

16. A baffle according to claim 1, wherein the reinforcement is fixed to the baffle plate by welding or by virtue of the reinforcement and the baffle plate being fabricated of a common sheet.

17. A baffle mountable on a heat transfer plate of a block-type heat exchanger, which block-type heat exchanger includes side panels surrounding an enclosure that is configured to have arranged therein the heat transfer plate and the baffle, the baffle comprising:

a baffle plate comprising:

a first longitudinal edge, a second longitudinal edge opposite the first longitudinal edge, a first transverse edge, and a second transverse edge opposite the first transverse edge;

a first surface and a second surface that face in opposite directions;

an engagement part that includes a groove configured to receive a part of the heat transfer plate when the baffle is mounted on the heat transfer plate, the groove extending along the first longitudinal edge of the baffle plate;

the first surface and the second surface of the baffle plate being parallel to each other and to a baffle plane located between the first surface and the second surface;

a reinforcement fixed to the baffle plate to improve strength of the baffle, the reinforcement possessing an outer surface, the reinforcement extending along the second longitudinal edge of the baffle plate and projecting away from the baffle plane; and a resilient member for resiliently abutting and sealing against one of the side panels when the heat transfer plate and the baffle are arranged in the enclosure, the resilient member being fixed to the reinforcement and extending along the reinforcement.

18. A baffle according to claim 17, wherein the first surface of the baffle plate lies in a first surface plane, the first surface plane intersecting and passing through the reinforcement and the resilient member.

19. A baffle according to claim 18, wherein the resilient member comprises a resilient fin and a portion to which the resilient fin is fixed, the portion of the resilient member being fixed to and facing the reinforcement, the resilient fin projecting away from the portion of the resilient member that is fixed to the reinforcement.

20. A baffle according to claim 19, wherein the first surface plane intersects and passes through the portion of the resilient member that is fixed to the reinforcement, an entirety of the resilient fin being spaced from the first surface plane.

21. A baffle mountable on a heat transfer plate of a block-type heat exchanger, which block-type heat exchanger includes side panels surrounding an enclosure that is configured to receive the heat transfer plate and the baffle, the baffle comprising:

a baffle plate comprising:

a first longitudinal edge, a second longitudinal edge opposite the first longitudinal edge, a first transverse edge, and a second transverse edge opposite the first transverse edge;

a first surface and a second surface that face in opposite directions, the first and second surfaces of the baffle plate being parallel to one another and to a baffle plane located between the first surface and the second surface;

a longitudinally extending reinforcement fixed to the baffle plate to improve strength of the baffle, the reinforcement possessing oppositely facing first and second surfaces, the reinforcement extending along the second longitudinal edge of the baffle plate and projecting away from the baffle plane;

a resilient member for resiliently abutting and sealing against one of the side panels when the heat transfer plate and the baffle are arranged in the enclosure, the resilient member being fixed to the reinforcement and extending along the longitudinally extending reinforcement; and the reinforcement being positioned between the baffle plate and the resilient member, with the resilient member projecting away from the second surface of the reinforcement and the baffle plate projecting away from the first surface of the reinforcement.

22. A baffle according to claim 21, wherein the first surface of the baffle plate lies in a first surface plane, the first surface plane intersecting and passing through the reinforcement and the resilient member.

* * * * *